United States Patent [19]

Ingenhoven

[11] Patent Number: 5,066,054

[45] Date of Patent: Nov. 19, 1991

[54] MOTOR-VEHICLE DOOR LATCH WITH ANTITHEFT FEATURE

[75] Inventor: Jürgen Ingenhoven, Velbert, Fed. Rep. of Germany

[73] Assignee: Kiekert GmbH & Kommanditgesellschaft, Heiligenhaus, Fed. Rep. of Germany

[21] Appl. No.: 617,026

[22] Filed: Nov. 23, 1990

[30] Foreign Application Priority Data

Nov. 22, 1989 [DE] Fed. Rep. of Germany ..... 3938680

[51] Int. Cl.[5] ..... E05C 3/26

[52] U.S. Cl. ..... 292/201; 292/216; 292/DIG. 27

[58] Field of Search ..... 292/201, 216, 280, DIG. 26, 292/DIG. 27

[56] References Cited

U.S. PATENT DOCUMENTS

| | | | |
|---|---|---|---|
| 3,563,589 | 2/1971 | Kwasiborski, Jr. | 292/216 |
| 3,591,220 | 7/1971 | Sandor | 292/216 |
| 3,695,662 | 10/1972 | Ploughman | 292/216 |
| 3,697,105 | 10/1972 | Marx | 292/216 |

*Primary Examiner*—Richard E. Moore

*Attorney, Agent, or Firm*—Herbert Dubno; Andrew Wilford

[57] ABSTRACT

A motor-vehicle door latch for use on a vehicle door having a handle and an inside locking element has a housing, a latch fork pivotal on the housing and engageable in a locking position with a door bolt to retain same and lock the door, an actuating lever pivoted on the housing and connected to the handle, a release pawl operatively engageable with the fork to release same from the locking position, and a link displaceable between a position coupling the actuating lever to the release pawl for displacement of the fork out of the locking position by actuation of the actuating lever and a position decoupling the actuating lever from the release pawl. Thus in the decoupling position actuation of the actuating lever will not unlock the door. A central actuator for the latch includes an actuator in the latch displaceable into an antitheft position, and a coupling having one side connected to the inside locking element and an opposite side connected to the link for coupling the link to the inside locking element for movement thereby between its positions except when the actuator is in the antitheft position of the actuator.

8 Claims, 5 Drawing Sheets

MOTOR-VEHICLE DOOR LATCH WITH ANTITHEFT FEATURE

FIELD OF THE INVENTION

The present invention relates to a motor-vehicle door latch. More particularly this invention concerns such a door latch having an antitheft feature.

BACKGROUND OF THE INVENTION

A standard motor-vehicle door latch has a housing mounted on the door edge and formed with a recess into which is engageable a bolt projecting from the respective door post. A fork is pivotal in the housing between a latching position engaging around the bolt and holding it solidly in the recess and a freeing position permitting the bolt to enter and leave the recess. A latch pawl engageable with the fork can hold it in the latched position. The latch pawl in turn is typically spring loaded and can be controlled via appropriate levers both from an inside door handle and an outside door handle, either of which can therefore operate the latch to allow the door to be opened.

In addition the door can be locked by means of a button or lever inside the door and a key cylinder outside the door, and also frequently by an actuator operated by a central lock system. When locked the outside door handle is either impeded from moving so it cannot move the latch pawl, or it is decoupled from the latch pawl so its actuation is ineffective.

In a standard lock system the inner door handle and inner lock button or lever remain effective even when the door is locked and the outside handle does not work. In an antitheft system as described in U.S. patent application Nos. 389,652 now patent No. 4,974,886, issued Dec. 4, 1990 and 596,926 respectively filed Aug. 4, 1989 and Oct. 12, 1990 there is, in addition to the locked and unlocked conditions of the latch, an antitheft mode or position in which the latch cannot be opened by either of the door handles and in which the inside lock element is also ineffective to unlock the door. Thus when in the antitheft position a would-be thief cannot even open the door by forcing the window and operating the door from inside.

As described in commonly owned patent application 389,834 now patent No. 4,978,154, issued Dec. 18. 1990, filed Aug. 4, 1990 the remotely operated antitheft mechanism uncouples the inside door-locking element from the door-opening mechanism when in the antitheft position, a substantial improvement on the earlier known system of the type described in U.S. Pat. No. 4,669,283 where the antilock mechanism merely blocks actuation of the inside door-locking element.

The main disadvantage of these systems is that when they are to be applied to motor vehicles that are also offered without antitheft or remote-actuator systems, it is necessary for the manufacturer or assembler to stock two entirely different set of locks. It is impossible to merely leave out elements of the antitheft elements for use in a system not to be thus equipped, as that would eliminate elements necessary to couple the lock-operating and -actuating elements to each other.

OBJECTS OF THE INVENTION

It is therefore an object of the present invention to provide an improved antitheft door latch.

Another object is the provision of such an improved antitheft door latch which overcomes the above-given disadvantages, that is which does not require special levers and actuating elements for the antitheft feature.

SUMMARY OF THE INVENTION

A motor-vehicle door latch for use on a vehicle door having a handle and an inside locking element according to this invention has a housing, a latch fork pivotal on the housing and engageable in a locking position with a door bolt to retain same and lock the door, an actuating lever pivoted on the housing and connected to the handle, a release pawl operatively engageable with the fork to release same from the locking position, and a link displaceable between a position coupling the actuating lever to the release pawl for displacement of the fork out of the locking position by actuation of the actuating lever and a position decoupling the actuating lever from the release pawl. Thus in the decoupling position actuation of the actuating lever will not unlock the door. According to the invention a central actuator for the latch includes an actuator in the latch displaceable into an antitheft position, and a coupling having one side connected to the inside locking element and an opposite side connected to the link for coupling the link to the inside locking element for movement thereby between its positions except when the actuator is in the antitheft position of the actuator.

This arrangement can therefore be applied a door latch of standard construction. The power actuator also serving as antitheft device is merely interposed between the inside locking element, typically a button, and the link lever so that not only can this power actuator lock or unlock the door, like the inside locking element, but it can also set the antitheft mode in which the door is locked and the inside locking element is decoupled.

According to another feature of this invention the coupling includes a slide having two relatively shiftable parts one of which is connected to the locking element and the other of which is connected to the link. The coupling further includes a catch connected to the parts for locking same together for joint movement except when in the antitheft position when they can move relative to each other. In addition according to the invention the central actuator further includes a catch-releasing element displaceable by the actuator in the antitheft position to act on the coupling slide and disconnect the slide parts from each other. The slide moves in a predetermined direction and the coupling includes two formations engaging together in a direction transverse to the predetermined direction. Furthermore the actuator includes a rotatable wheel carrying at least one eccentric operatively engageable with the slide. This wheel has an actuator bump operatively engageable with the catch-releasing element to act on the coupling. The actuator includes an electric motor and worm drive connected to the wheel.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
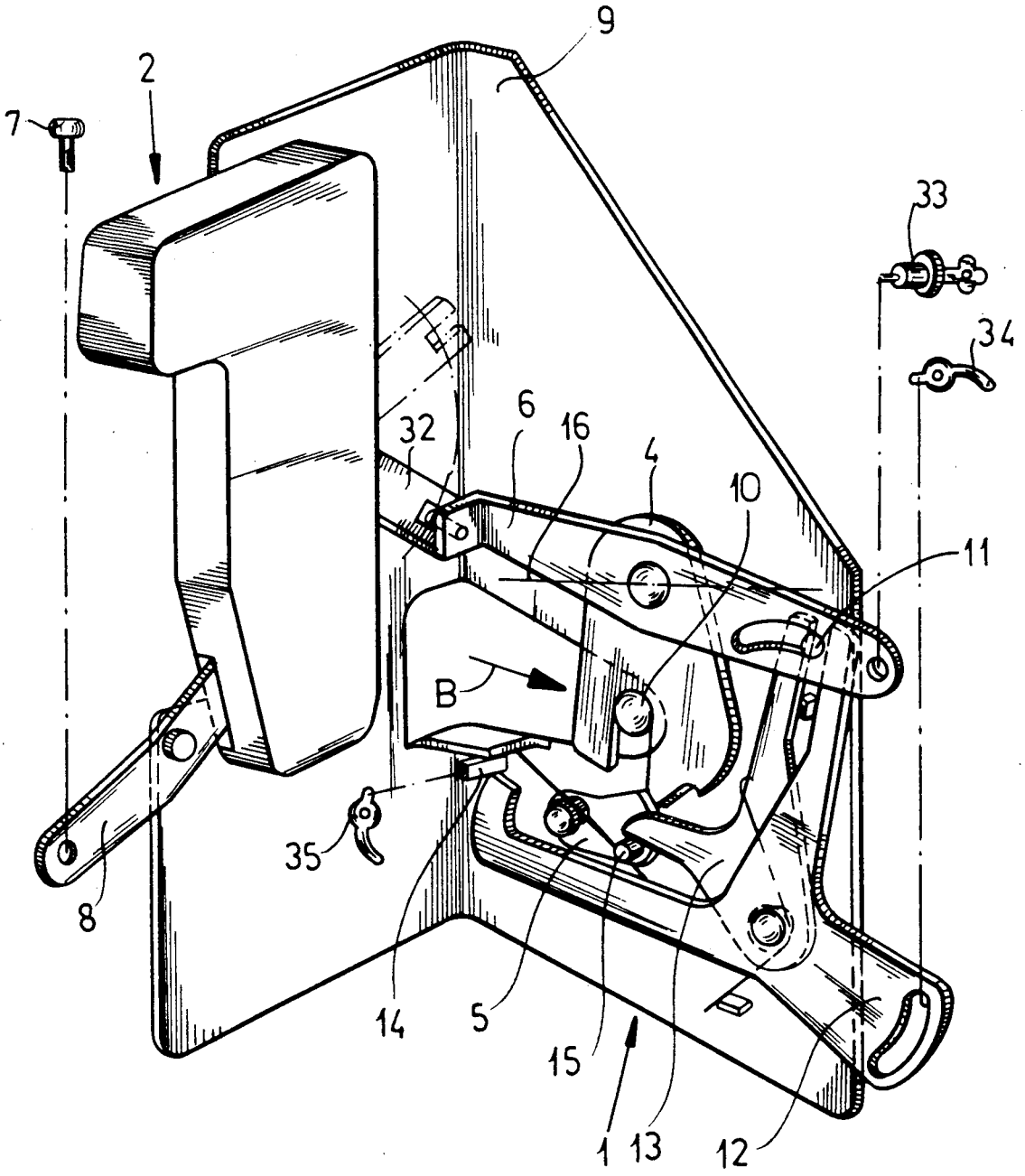
FIG. 1 is a partly schematic perspective view of a door latch according to this invention, with the elements part of the way from the locked to the unlocked position.

As seen in FIG. 1 a motor-vehicle door latch 1 has a housing 9 normally mounted on a door edge and formed with a cutout into which a bolt 10 normally projecting from a doorpost can move in a direction B. The housing 9 carries an antitheft mechanism 2 having (FIGS. 2 through 4) an electric motor 3, and is provided with a pivotal lock fork 4 that can engage around the bolt 10 and that can be held in the illustrated locked position by a spring-loaded latch pawl 5.

An outside door handle 34 is directly coupled to an actuating lever 12 that can also be operated by a lever 14 connected to an inside door handle 35. In addition an outside door-locking element 33, here a lock cylinder, can act directly on a link lever 6 that is coupled via another lever 32 to lever 8 in turn operable by an inside door-locking button 7. A coupling lever 13 has one arm engaging a rivet 15 on the release pawl 5 and another arm that can be engaged by a coupling slide 11 carried on the link lever 6.

The actuating lever 12 has an arm that can act via the slide 11 on the lever 13 only when the link lever 6 is in the illustrated unlocked position. Pivoting of the lever 6 to a locked position parallel to a line 16 pulls the slide 11 out of the path of the arm of the lever 12 so that its actuation by either the outside handle 34 or inside handle 35 will not be effective to pivot the coupling lever 13 and pull down the release pawl 5. Thus the position of the lever 6 determines whether the door handles 34 and 35 are coupled to the latch mechanism. This position is determined on the one hand by actuation of the outside element 33 for locking and unlocking the door and on the other hand by the inside element 7.

Figure 2:
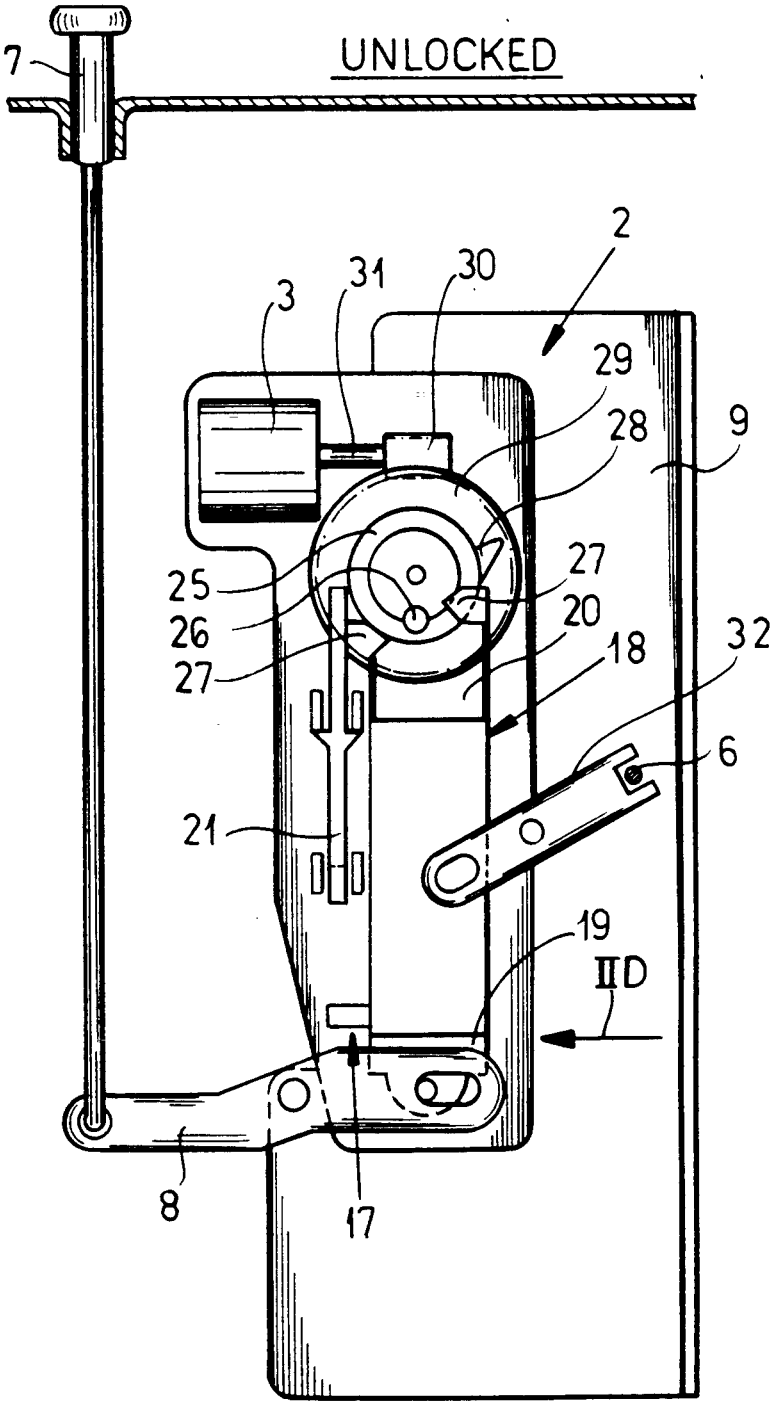
FIG. 2 is a vertical section through the antitheft mechanism of the door latch in the unlocked condition.
Figure 3:
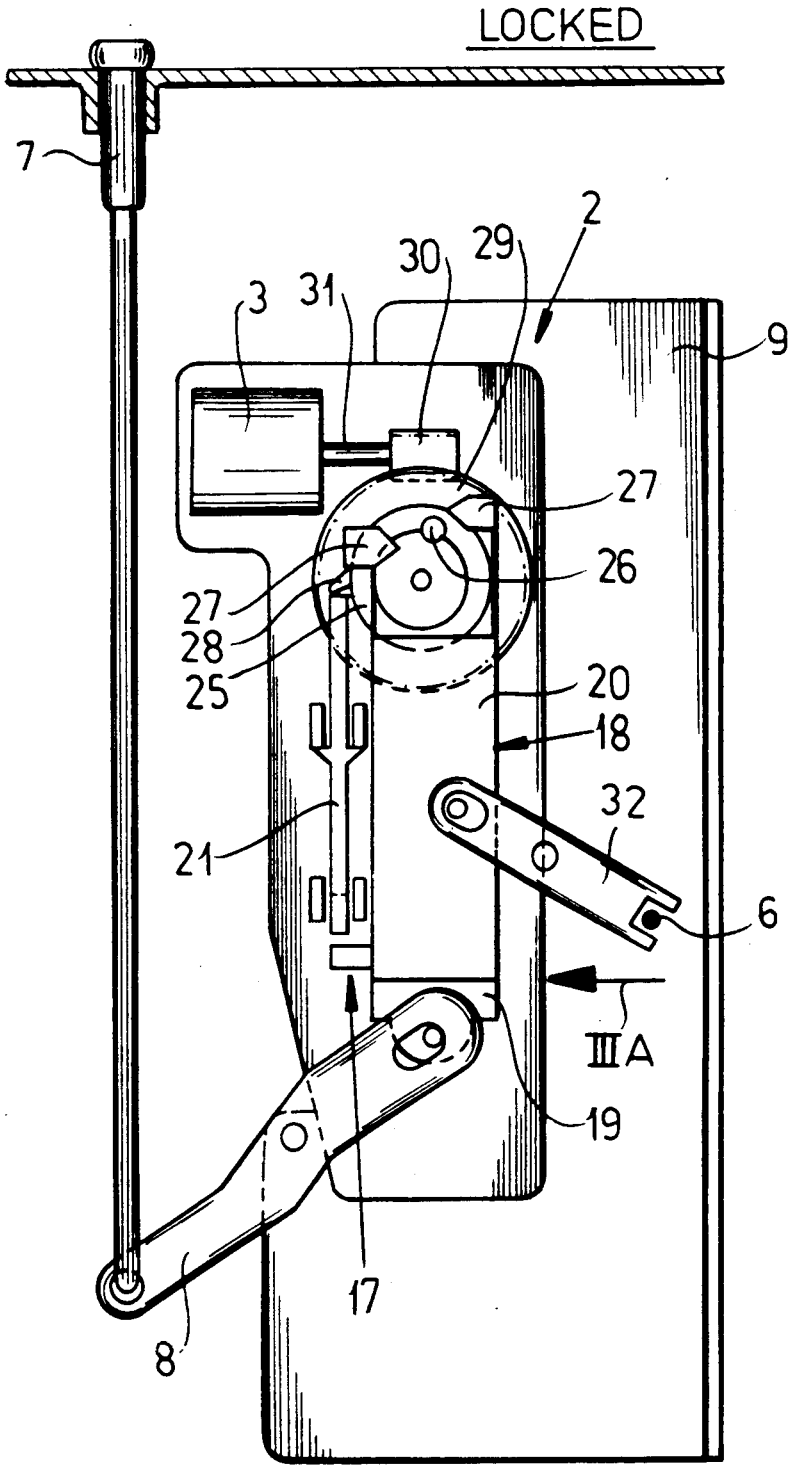
FIGS. 3, 3A and 4, 4A are views like FIGS. 2, 2A through the antitheft mechanism but in the locked and antitheft positions, respectively.
Figure 4:
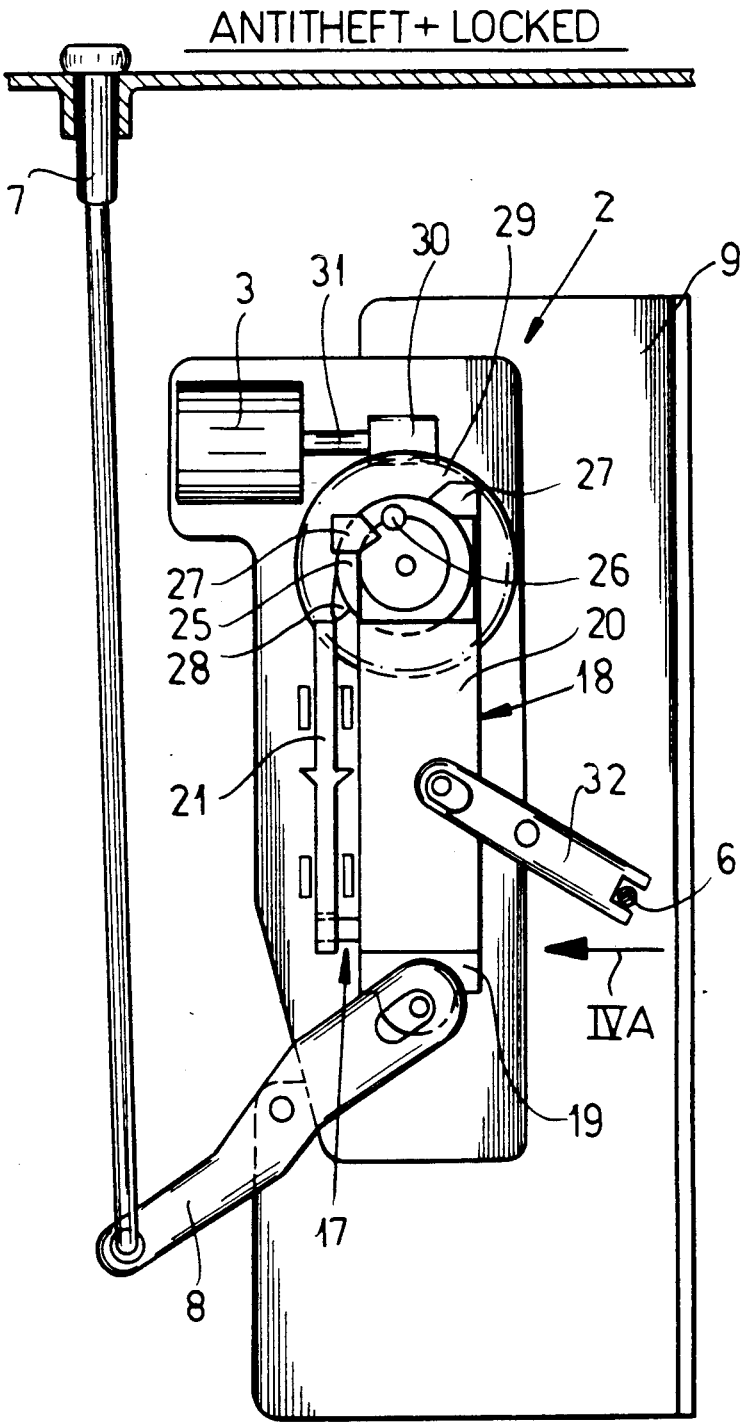

According to this invention, however, the connection between the inside element 7 and the lever 6 is via the antitheft mechanism 2 which is shown in better detail in FIGS. 2 through 4. This antitheft mechanism 2 comprises a slide 18 that is vertically displaceable and that had a foot part 19 on which the lever 8 is pivoted and a head part 20 on which the lever 32 is pivoted and which can telescope on the foot part 19. These two parts 19 and 20 are relatively displaceable as seen by a comparison of FIGS. 4 and 5 and can be latched together for joint movement by a catch 17.

The motor 3 has a shaft 31 carrying a worm 30 meshing with a gear wheel 29 carrying another wheel 25 itself carrying an eccentric pin 26. The head 20 of the slide 18 has a pair of deflectable abutments 27 engageable by this pin 26 to move it between end positions shown respectively in FIGS. 2 and 3. Unillustrated limit switches actuated by the slide 18 stop the motor 3 in the end positions as is well known in the art. In addition the wheel 25 carries a pusher formation 28 that can engage a vertically displaceable catch-actuator rod 21 that is normally biased upward by an unillustrated spring and that serves to operate the catch 17.

Figure 2A:
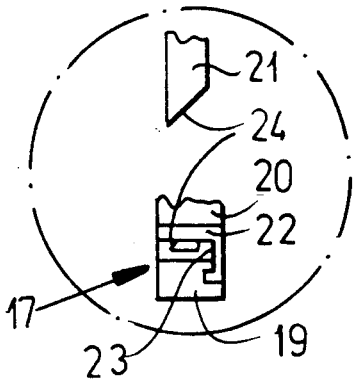
FIG. 2A is a large-scale view of a detail of the mechanism of FIG. 2 taken in the direction of arrow IIA of FIG. 2.
Figure 3A:
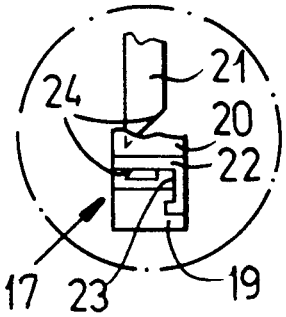
Figure 4A:
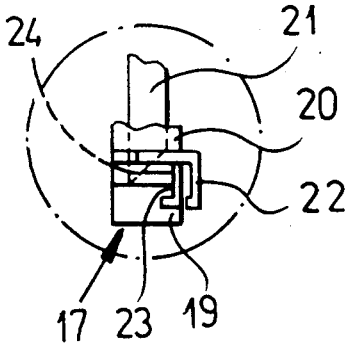

As seen in FIGS. 2A, 3A, and 4A, the catch 17 comprises a pair of interfitting entrainment formations 22 and 23 formed on the head 20 and foot 19, respectively, and operating formations 24 formed on the end of the rod 21 and on the formation 22. The two entrainment formations 22 and 23 are spring loaded to normally latch the head 20 and foot 19 together for joint movement, but when the rod 21 is pushed down to engage the operating formations 23 and 24 together, the entrainment formations 22 and 23 disengage from each other and permit the foot 19 to telescope out of the head 20, if necessary.

The latch described above functions as follows:

In the unlocked position as shown in FIGS. 2 and 2A the pin 26 is midway between the abutments 27 and the rod 28 is lifted so the catch 17 is closed. Thus the foot 19 and head 20 are coupled together so that a depression of the button will raise the slide 18 and pivot the lever 32, thereby raising the coupling slide 11 and decoupling the actuating lever 12 from the coupling lever 13 as shown in FIG. 3. The same effect can be achieved by rotation of the wheel 25 by the motor 3 through 180° as also seen by a comparison of FIGS. 2 and 3. Thus the door can be locked and unlocked both manually and by the motor 3.

Figure 5:
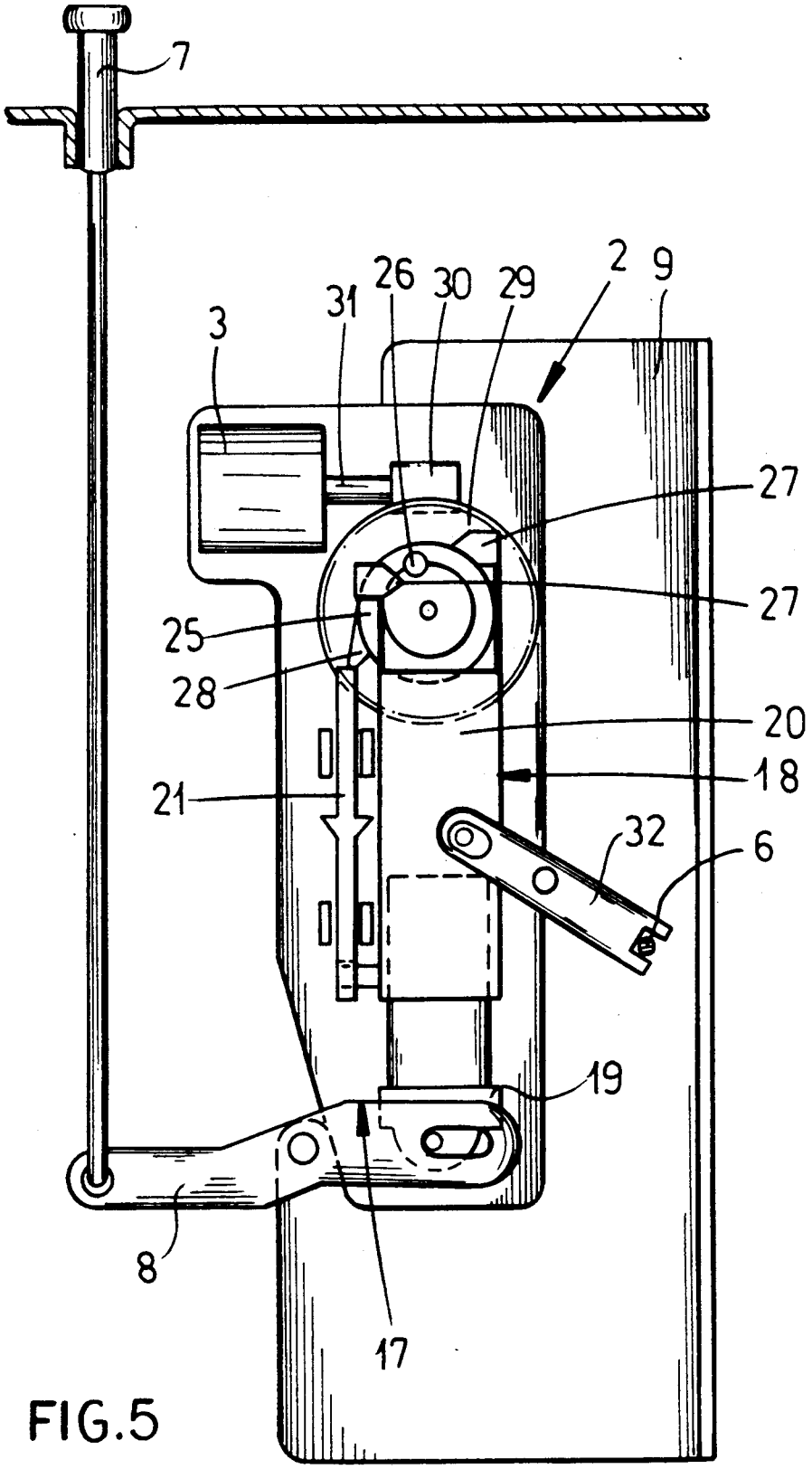
FIG. 5 is a view like FIG. 4, but showing the latch in the antitheft position when an attempt has been made to actuate the inside unlocking element.

To set the latch in the antitheft position the motor 3 rotates the wheel 25 more counterclockwise until the bump 8 comes to rest atop the catch-actuating rod 21 and pushes it down, thereby opening up the catch 17 as shown in FIG. 4 and 4A. In this position a lifting of the button 7 as indicated in FIG. 5 will merely serve to telescope out the foot part 19 of the slide 18, but this motion will not be transmitted via the levers 32 and 6 to the coupling slide 11 and the door will remain locked.

I claim:

1. A motor-vehicle door latch for use on a vehicle door having a handle and an inside locking element, the latch including:

a housing;

a latch fork pivotal on the housing and engageable in a locking position with a door bolt to retain same and lock the door;

an actuating lever pivoted on the housing and connected to the handle;

a release pawl operatively engageable with the fork to release same from the locking position;

a link displaceable between a position coupling the actuating lever to the release pawl for displacement of the fork out of the locking position by actuation of the actuating lever and a position decoupling the actuating lever from the release pawl, whereby in the decoupling position actuation of the actuating lever will not unlock the door; and central actuating means including an actuator in the latch displaceable into an antitheft position, and a coupling having one side connected to the inside locking element and an opposite side connected to the link for coupling the link to the inside locking element for movement thereby between its positions except when the actuator is in the antitheft position of the actuator.

2. The motor-vehicle door latch defined in claim 1 wherein the coupling includes a slide having two relatively shiftable parts one of which is connected to the locking element and the other of which is connected to the link, and a catch connected to the parts for locking same together for joint movement except when in the antitheft position when they can move relative to each other.

3. The motor-vehicle door latch defined in claim 2 wherein the central actuating means further includes a catch-releasing element displaceable by the actuator in the antitheft position to act on the catch and disconnect the slide parts from each other.

4. The motor-vehicle door latch defined in claim 3 wherein the slide moves in a predetermined direction and the coupling includes two formations engaging together in a direction transverse to the predetermined direction.

5. The motor-vehicle door latch defined in claim 4 wherein the actuator includes a rotatable wheel carrying at least one eccentric operatively engageable with the slide.

6. The motor-vehicle door latch defined in claim 5 wherein the wheel has an actuator bump operatively engageable with the catch-releasing element to act on the coupling.

7. The motor-vehicle door latch defined in claim 6 wherein the actuator includes an electric motor and worm drive connected to the wheel.

8. A motor-vehicle door latch for use on a vehicle door having a handle and an inside locking element, the latch including:

a housing;

a latch fork pivotal on the housing and engageable in a locking position with a door bolt to retain same and lock the door;

an actuating lever pivoted on the housing and connected to the handle;

a release pawl operatively engageable with the fork to release same from the locking position;

a link displaceable between a position coupling the actuating lever to the release pawl for displacement of the fork out of the locking position by actuation of the actuating lever and a position decoupling the actuating lever from the release pawl, whereby in the decoupling position actuation of the actuating lever will not unlock the door; and central actuating means including an actuator in the latch displaceable into an antitheft position, a slide having two relatively shiftable parts one of which is connected to the locking element and the other of which is connected to the link, and a catch connected between the parts of the slide for coupling the parts together and thereby coupling the link to the inside locking element for movement thereby between its positions except when the actuator is in the antitheft position of the actuator.

* * * * *